US006065574A

United States Patent [19]

Miyoshi

[11] Patent Number: 6,065,574

[45] Date of Patent: May 23, 2000

[54] BAG MOUNTED WITH CASTERS

[75] Inventor: Etsuo Miyoshi, Okawa-gun, Japan

[73] Assignee: Swany Corporation, Kagawa, Japan

[21] Appl. No.: 09/002,678

[22] Filed: Jan. 5, 1998

[30] Foreign Application Priority Data

Jan. 7, 1997 [JP] Japan ..... 9-013126

[51] Int. Cl.[7] ..... A45C 5/14; A45C 13/26

[52] U.S. Cl. ..... 190/18 A; 190/39; 190/115

[58] Field of Search ..... 190/18 A, 102, 190/115, 39; 16/115

[56] References Cited

U.S. PATENT DOCUMENTS

| | | | |
|---|---|---|---|
| 1,616,632 | 2/1927 | Mastrontonio | 190/115 X |
| 3,895,696 | 7/1975 | Urushibara | 190/115 X |
| 4,995,487 | 2/1991 | Plath | 190/18 A |
| 5,197,578 | 3/1993 | Van Hooreweder | 190/18 A |
| 5,197,579 | 3/1993 | Bieber et al. | 190/115 X |
| 5,330,037 | 7/1994 | Wang | 190/18 A X |
| 5,339,934 | 8/1994 | Liang | 190/115 X |
| 5,377,795 | 1/1995 | Berman | 190/18 A |
| 5,394,965 | 3/1995 | Kho | 190/18 A X |
| 5,464,080 | 11/1995 | Liang | 190/18 A |
| 5,497,865 | 3/1996 | Yun-Pi | 190/115 |
| 5,547,052 | 8/1996 | Latshaw | 190/102 X |
| 5,547,053 | 8/1996 | Liang | 190/18 A X |
| 5,564,538 | 10/1996 | Sadow | 190/18 A |
| 5,581,847 | 12/1996 | Hsieh | 16/115 |
| 5,615,757 | 4/1997 | Chen | 190/115 |
| 5,630,521 | 5/1997 | Waddell et al. | 190/18 A X |
| 5,676,223 | 10/1997 | Cunningham | 190/109 |

FOREIGN PATENT DOCUMENTS

| | | | |
|---|---|---|---|
| 2661807 | 11/1991 | France | 190/18 A |
| 3636064 | 4/1988 | Germany | 190/115 |
| 4221215 | 1/1994 | Germany | 190/102 |
| 352459 | 11/1937 | Italy | 190/115 |
| 57-179824 | 11/1982 | Japan . | |
| 63-131634 | 8/1988 | Japan . | |
| 4-76686 | 12/1992 | Japan . | |
| 2111465 | 7/1983 | United Kingdom | 190/115 |
| 2287644 | 9/1995 | United Kingdom . | |
| 88/07823 | 10/1988 | WIPO . | |
| 95/19721 | 7/1995 | WIPO . | |

*Primary Examiner*—Sue A. Weaver
*Attorney, Agent, or Firm*—Wenderoth, Lind & Ponack, L.L.P.

[57] ABSTRACT

A bag mounted on universal casters at a bottom of the bag body so that the movement direction of the bag can be freely changed. The bag has guide pipes or one wide breadth guide pipe fixed to one of the lateral faces of the bag body. A vertically extendable and retractable handle is provided and includes a grip and a pair of vertical rods which are inserted in the guide pipes. The grip includes a connecting portion which interconnects the upper ends of the vertical rods. Stoppers are provided to lock the handle in a fully vertically extended position. The grip is also provided with a gripping portion which extends in a longitudinal direction of the bag body and is located at approximately a middle portion of the bag body. The gripping portion is perpendicular relative to the connecting portion.

26 Claims, 11 Drawing Sheets

BAG MOUNTED WITH CASTERS

BACKGROUND OF THE INVENTION

The present invention relates to a bag mounted on casters, and in particular, to a bag having a vertically extensible handle. The term "bag", in the present invention, is used broadly to refer to suit-cases and attache-cases.

Bags provided with casters and a freely extensible handle, have already been developed and widely used. Many types of bags having this structure can be boarded or stored in the passenger cabin of airplanes. For example, known bags having the above-described structure are disclosed in U.S. Pat. No. 4,995,487; Japanese Patent Publication No. 4-76686, issued Dec. 4, 1992; Japanese Non-examined utility Model Publication No. 57-179824, issued Nov. 15, 1982; and Japanese Non-examined utility Model Publication No. 63-131634, issued Aug. 29, 1988. The bags described in these publications are provided with two casters mounted on one side of a bottom face of the bag, as shown in FIG. 1 of the present invention. Short legs 2 are fixed on an opposite side of the bottom face of the bag, relative to the two casters. The casters 1 and the legs 2 contact the floor when the bag is in a vertical position. In the vertical position, the bag can stand upright without moving because the legs 2 are in contact with the floor. Further, the extensible handle 3 is provided at an upper face of the bag so as to allow the bag to be pulled. The casters 1 are mounted on the same side of the bag as the handle because the bag is pulled while in a slanted or tilted orientation.

As shown in FIG. 1, the prior art bag can be moved when it is tilted and pulled by the handle 3. When the bag is tilted, only the casters 1 are in contact with the floor. When the handle 3 is pulled in the tilted orientation, the casters 1 turn in order to facilitate movement of the bag. However, bags moving in this fashion sometimes do not allow the casters 1 to be used in narrow places like the interior of planes or in crowded areas. When the bag is moved using the casters 1, the widest dimension of the bag is perpendicular to the movement direction, and thus the bag cannot be moved freely in the aisles of an airplane cabin or in crowded areas.

The bag mounted on casters allows large, heavy bags to be easily moved. This is because, even if the bag is heavy, it is easily pulled along on the rolling casters. In order to solve the drawbacks associated with prior art bags, the inventor of the present invention previously developed the bag shown in the FIG. 2. The bag shown in FIG. 2 has casters 21 fixed at a bottom face 24A of bag body 24. The casters 21 are mounted at the four corners of the bottom face in order to allow the bag body 24 to be self-standing while in an upright position. A grip 27 of the handle 23 is located at the center of the upper face of the bag body 24. Also, as opposed to bag shown in the FIG. 1, the bag of FIG. 2 does not have to be tilted in order to move the bag. The bag is moved in the direction shown by the arrow of the FIG. 2 while remaining in an upright vertical position. Therefore, when the bag is moved in the direction shown by the arrow, the widest dimension of the bag is parallel to the movement direction. For this reason, the bag has the advantage that it can be conveniently moved in an airplane cabins or in crowded areas. Further, by using freely spinning casters which allow movement in any direction, the bag can be freely moved in any direction while in an upright position. Note that the upright bag does not transmit the weight of the bag to the handle 23. Therefore, even a fairly heavy bag can be easily pushed and moved.

The bag of FIG. 2, uses four casters 21 which allows easy movement thereof. However, a guide pipe, which connects the handle 23 to the bag body 24, causes a reduction in the interior storage capacity of the bag body 24. The reduction in storage capacity becomes an even greater problem as the bag body 24 gets thinner. This is because the guide pipes generally occupy the same volume in the bag body 24, regardless of the thickness of the bag body 24. In particular, the guide pipes have to be mounted at the center of the bag body 24 in order to allow the bag to be pushed with good balance, and this will limit the thickness of an item which can be stored inside the bag body 24. Items of almost the same thickness as the bag body can be stored inside a bag body without guide pipes. In comparison, bags with guide pipes at the center of the bag body permit the storage of items which are less than half the thickness of the bag body due to the volume of interior space occupied by the guide pipes.

Further, the bag supported on casters not only allows movement of the bag regardless of the weight of the items stored inside of the bag, but also allows easy movement thereof because it can be used as a walking stick. In the bag shown in FIG. 2, the vertical rods 26 are stopped by means of stopper in an extended position, thereby setting the height of the grip 27 at 80 to 90 cm which allows the handle to be used as a walking stick. However, it is necessary to reinforce the bottom face of the bag so as to allow it to be used as a stick. A bending force is applied to the bottom face of the bag when the grip is pushed. Therefore, in order to avoid distortion of the bottom face, it is necessary to strongly reinforce the bottom face of the bag. The bag becomes heavier when reinforced, and for example it cannot be easily moved when lifted and carried on stairs.

SUMMARY OF THE INVENTION

Accordingly, an object of the present invention is to solve the above described drawbacks, and thus the essential scope of the present invention is to minimize the reduction of storage capacity due to the guide pipes which fix the handle to the bag body, and to provide a bag which is light in weight and can be used as a walking stick.

Further, an object of the present invention is to provide a bag that can be easily moved in any direction while pushing an extensible handle having a grip which is designed to be comfortably held, even in the case of a thin bag body.

Further, another object of the present invention is to provide a bag that can be easily and smoothly moved while in crowded areas.

Further, another object of the present invention is to provide a bag that can be freely moved in a desired direction without easily falling over, even if the bag body is thin.

Further, another object of the present invention is to provide a bag that can be rapidly moved without easily falling over, even when pushed on an uneven surface and supported on small casters.

The bag of the present invention is provided with casters and a bag body which can be freely opened and closed. The casters are mounted at the corners of a bottom face of the bag body so as to allow movement of the bag while in a self-standing upright position. A freely vertically extensible handle is fixed to the bag body. The handle has a handle grip at its upper extremity and vertical rods which are fixed to the grip. The vertical rods are inserted into guide pipes in a freely extensible fashion and are fixed to the bag body via the guide pipes.

Furthermore, each of the casters is of a type which allows the bag to be moved in all directions when the bag is standing in a vertical or upright posture. Alternatively the casters mounted at the far side of the bottom face, relative to the handle, may be universal casters which allow a movement direction of the bag body to be freely changed. The two guide pipes are fixed to both sides of one of the lateral faces of the bag body. The guide pipe extend vertically, so as to fix the handle to one of the lateral faces of the bag body. The handle is provided with the two vertical rods which are interconnected by the grip which is fixed to the upper ends of the vertical rods. The vertical rods, which are inserted into the guide pipes, allow the handle to be used as a walking stick and the bag to be moved by pushing. Also, the vertical rods are provided with stoppers to stop them in the vertically extended position and to maintain them in the vertically extended position. The grip defines a connecting portion which links the two vertical rods and a gripping portion which extends in a longitudinal direction of the bag body and is perpendicular to the connecting portion. The stoppers function to stop the vertical rods in a position at which the gripping portion of the grip is located between 60 and 100 cm from the lower surfaces of the casters so as to allow the bag to be used as a walking stick. The gripping portion is positioned at approximately the middle of the upper face of the bag body to allow a user to hold it in from opposites of the bag body while the rods are in the extended position. The bag, in an upright position, is moveable in any direction by grasping the gripping portion, with the vertical rods of the handle in the extended position.

The bag of the present invention can also be constructed so as to have only one vertical rod. In this type of bag construction, a wide breadth guide pipe is fixed to one of the lateral faces of bag body. The flattened guide pipe extends vertically and has a wide side which is parallel to the lateral face of the bag body. The vertical rod is a wide breadth or flattened type rod that can be freely inserted into the wide breadth guide pipe. A grip is fixed at an upper end of the vertical rod. The grip is provided with a connecting portion linking the wide breadth vertical rod to a gripping portion which extends in the longitudinal direction of the bag body and is perpendicular to the connecting portion.

The bag having this type of construction provides the following advantages.

1. Reduction of the storage capacity of the bag body is minimized due to the manner in which the guide pipes are fixed to the bag body. It is possible to store thick items in the bag body even in a bag body which is relatively thin. This is because the guide pipes of the bag of the present invention which fix the grip to the bag body in a freely extensible fashion, are mounted on one of the lateral faces of the bag body. The guide pipes, or even one wide breadth guide pipe, can be fixed to the lateral face without occupying a large volume of the interior bag body storage space. In particular, the handle portion of the grip is located over a central portion of the bag body and extends in the longitudinal direction of the bag body because the guide pipes, the vertical rods and the grip of the bag of the present invention form a unique structure. For this reason it is possible to move the bag in a desired direction and, in contrast to the bag shown in FIG. 2, it is not necessary to fix the guide pipes inside of the bag body, and thus, loss of storage capacity is minimized.

2. The bag of the present invention is light in weight and the extendible handle can be used as a walking stick. The reason is that the guide pipes of the present invention are mounted on one of the lateral sides of the bag body. The bag of this construction allows the handle to be used as a walking stick by stopping and locking it at the fully upwardly extended position. When the handle is used as a walking stick, a downward force is applied on the grip and transmitted to the casters near the lateral face of the bag body to which the guide pipes are fixed. In other words, the downward pushing force is almost directly applied to both of these casters and does not constitute a force that will tend to bend the bottom face of the bag body. Therefore, it is not necessary to reinforce the bottom face of the bag even though the handle can be used as a walking stick. For this reason, the bag body can be constructed so that it is light in weight.

3. Even if the bag body is thin, it is possible to lengthen the gripping portion of the grip so as to provide a grip which is easy to hold because it is formed of the connecting portion which links the grip to the guide pipes and of the gripping portion which extends along the longitudinal direction of the bag body. The grip facilitates easy movement of the bag, in any direction, while pushing the bag body by grasping the grip of the extended handle. In particular, it is possible to move the bag in any desired direction, while holding the long gripping portion, by adjusting the moving direction and the orientation of the bag body because the two casters mounted adjacent a side of the bag body remote from the handle, or all four of the casters are universal casters which allow the movement direction to be easily changed.

4. The bag of the present invention allows smooth and easy movement while in crowded areas. This is because the guide pipes are fixed on one of the lateral faces of the bag body and the vertical rods are inserted in the guide pipes so as to be slidable therein. The connecting portion fixes the grip to the upper ends of the vertical rods. The bag body can be moved in a stable manner while holding the grip and pushing the bag body. Therefore, like the bag shown in the FIG. 1, it is not necessary to pull the bag body backwards in order to effect movement thereof. When the bag is moved in crowded conditions, it is possible to view both the people and the bag body so that bag can be carefully moved without hurting anyone. Also, one can move the bag smoothly in crowded areas by holding the grip of the bag and pushing the bag body while adjusting both the orientation of the bag and the moving direction thereof.

5. The bag of the present invention can be freely moved in a desired direction without easily tipping over, even if the bag body is thin. The reasons that the bag can be stably moved in an upright position are that the grip is fixed, via the guide pipes and the vertical rods, to one side of the bottom face of the bag body and the gripping portion of the grip can be lengthened by extension in the longitudinal direction of the bag body. Holding the gripping portion, which extends in the longitudinal direction of the bag body, prevents the bag body from falling to one side. This is because the grip is positioned at the top and is separated from the bag body. It is also possible to mount the grip so that it extends in a lateral direction or in a direction perpendicular to the former longitudinal direction. However, with the grip aligned in this direction, it is necessary to very firmly hold the grip when moving the bag because, if the hand slips along the grip, the bag body will lean to one side and will fall over. Nevertheless, with the bag of the present invention, the bag body will not lean to the side and it will not fall over even if the hand slips along the grip. For this reason, the bag body can be easily moved while surely preventing the tipping over of the bag body. Further, the gripping portion that extends in the lateral direction has a drawback in that it is difficult to hold because it cannot be longer than the width of the bag body and when the bag body is thin, and therefore the overall length of the gripping portion is short. In contrast, because the gripping portion of the bag of the present invention extends in the longitudinal direction of the bag body and is perpendicular to the connecting portion, it allows firm and easy gripping even if the bag body is thin and the width of the two guide pipes are narrow.

6. The bag of the present invention also allows quick movement of the bag over uneven surfaces even when supported on smaller casters. This is because the grip is fixed to one side of the bottom face of the bag body adding to the possibility of extending the grasp in the longitudinal direction of the bag body. When a bag body is gripped at a front part of the bag body it can easily tip over when it is moved and when the casters hit pebble stones which hinder the smooth movement of the bag. However, the bag of the present invention efficiently prevents the bag body from falling forward in the case of pebble stones by moving the bag with the forward casters lifted out of contact with the ground. The bag can be moved in this manner because it can be moved while holding a gripping portion which extends toward a rear portion of the bag body.

The above and further objects and features of the present invention will be more fully apparent from the following detailed description along with reference to the accompanying drawings.

DETAILED DESCRIPTION OF THE INVENTION

Figure 1:
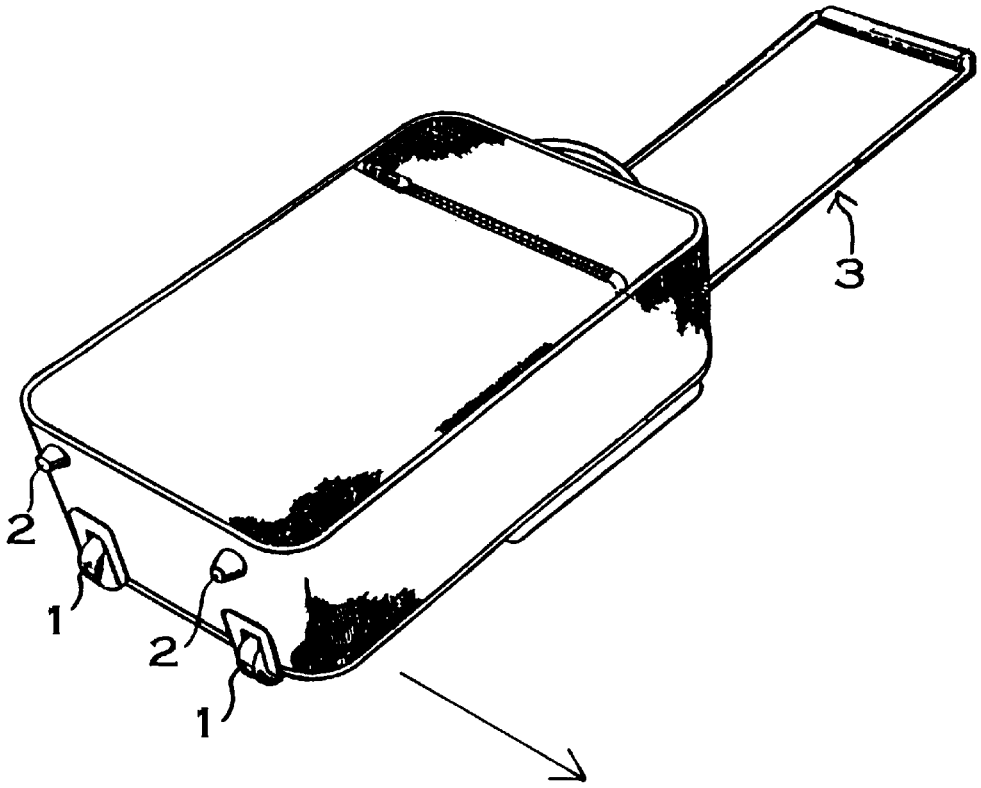
FIG. 1 PRIOR ART
FIG. 1 is a perspective view showing a prior art bag mounted on casters.
Figure 2:
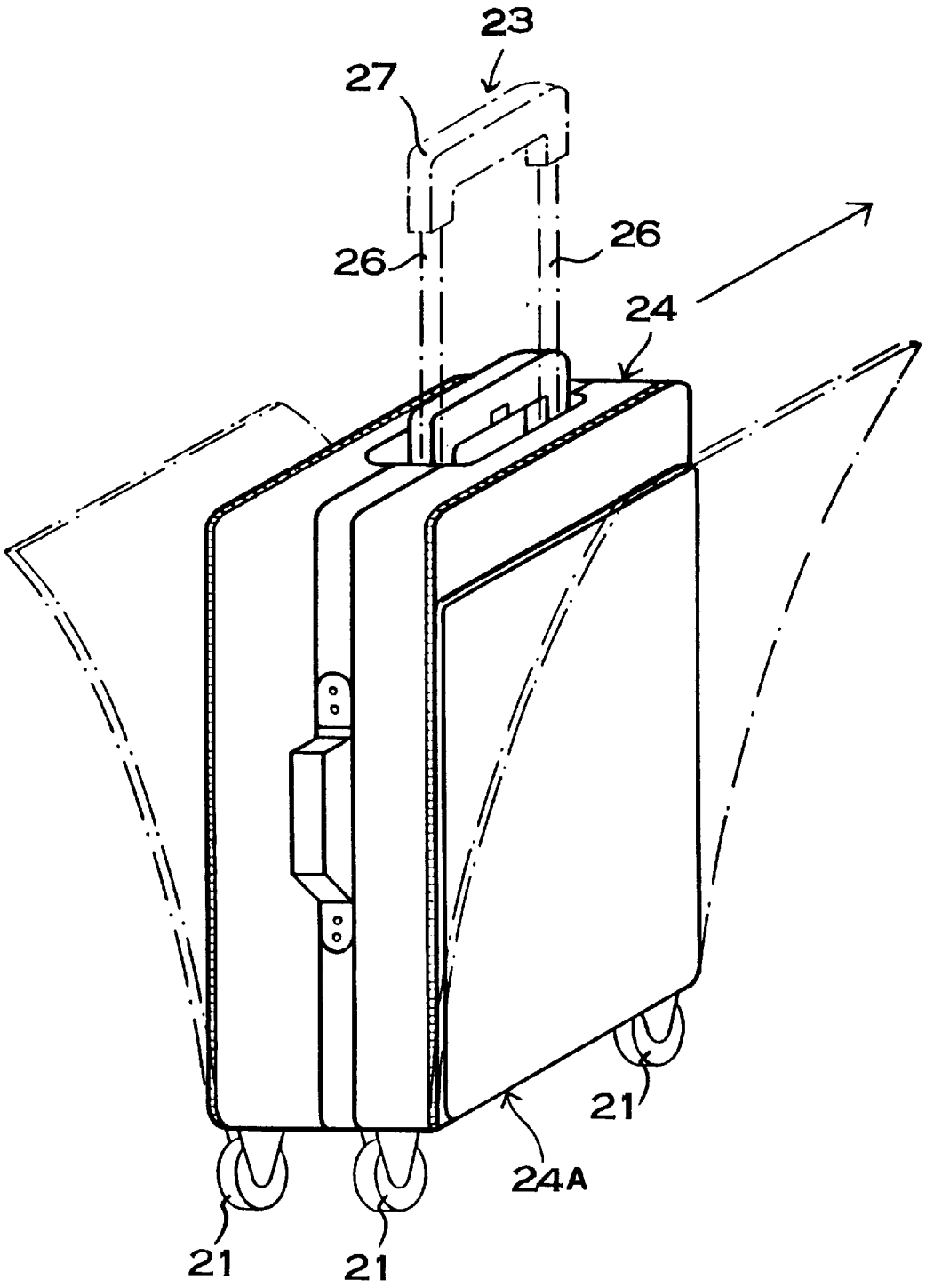
FIG. 2 is a perspective view of a bag formerly invented by the present inventor.
Figure 3:
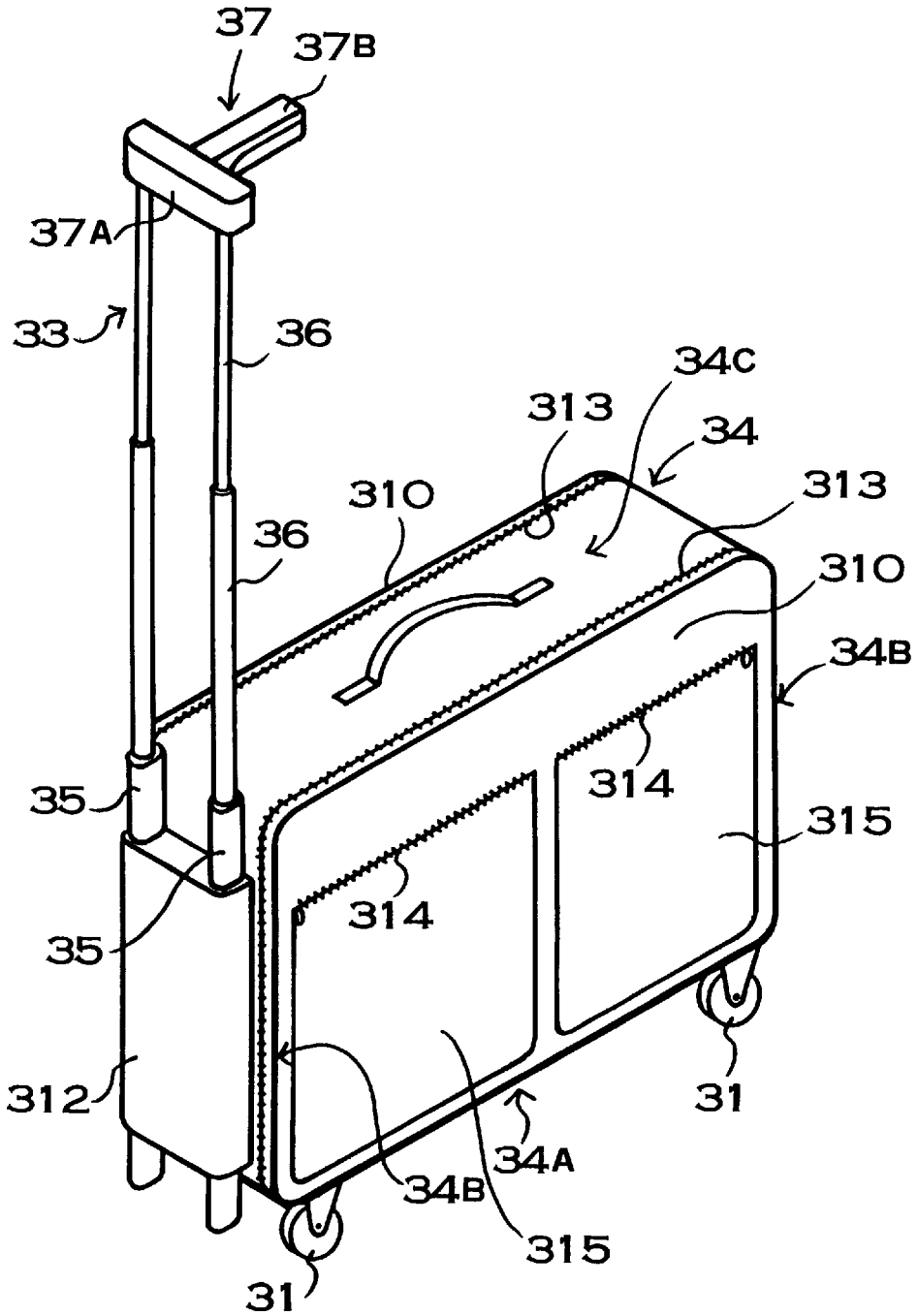
FIG. 3 is a perspective view of a bag constructed in accordance with a first embodiment of the present invention.

The bag shown in FIG. 3 has caster supports fixed to a bottom face 34A of a bag body 34 and casters 31 fixed to the caster supports at the four corners of the bottom face, respectively. A vertically extendible handle 33 is mounted on the bag body 34.

The bag body 34 includes the bottom face 34A, opposing lateral side faces 34B each connected at a lower end to bottom face 34A, an upper face 34C connected to the upper ends of lateral side faces 34B, and a cover 310 for closing each of the opposing longitudinal sides so as to permit opening and closing of the longitudinal sides. As shown in FIG. 3, a carrying handle is provided on upper face 34C. The bag body is composed of the bottom face 34A, the lateral faces 34B and the upper face 34C and covers 310 provided on both open longitudinal sides to allow opening and closing of these openings. The covers 310 are fixed to the lower portions of the bag body and can be bent so that the totality of the longitudinal side of the bag body can be opened. The covers 310 are connected to the peripheral vertical edges and the upper edge of the lateral side faces by chucks or a zipper 313 which connect the edges of the lateral side faces 34B to the covers 310. The cover 310 shown in FIG. 3 has two pockets 315 on which are closeable by chucks or zipper 314. It is also possible to place pockets on an inner face of each of the covers 310.

The dimensions of the bag body can have for example the three (small, medium and large) types hereunder described.

Small: 38 (length)×30 (height)×15 (width) cm

Medium: 41 (length)×32 (height)×16 (width) cm

Large: 44 (length)×34 (height)×17 (width) cm

However, the bag of the present invention is not limited to a bag body with the above-mentioned dimensions.

The preferable dimensions for a bag body which is self-standing and can be moved by pushing are: thickness from 10 to 25 cm, and length from 20 to 50 cm. A bottom face 34A with a size of over 10 cm (width)×20 cm (length) is suitable to allow the bag to be stably moved while in a vertical position. The airplane cabin type bag dimensions are: a width of 15 to 20 cm and a length of 35 to 45 cm. The plane cabin type bag has to have a length which is less than 50 cm.

Figure 4:
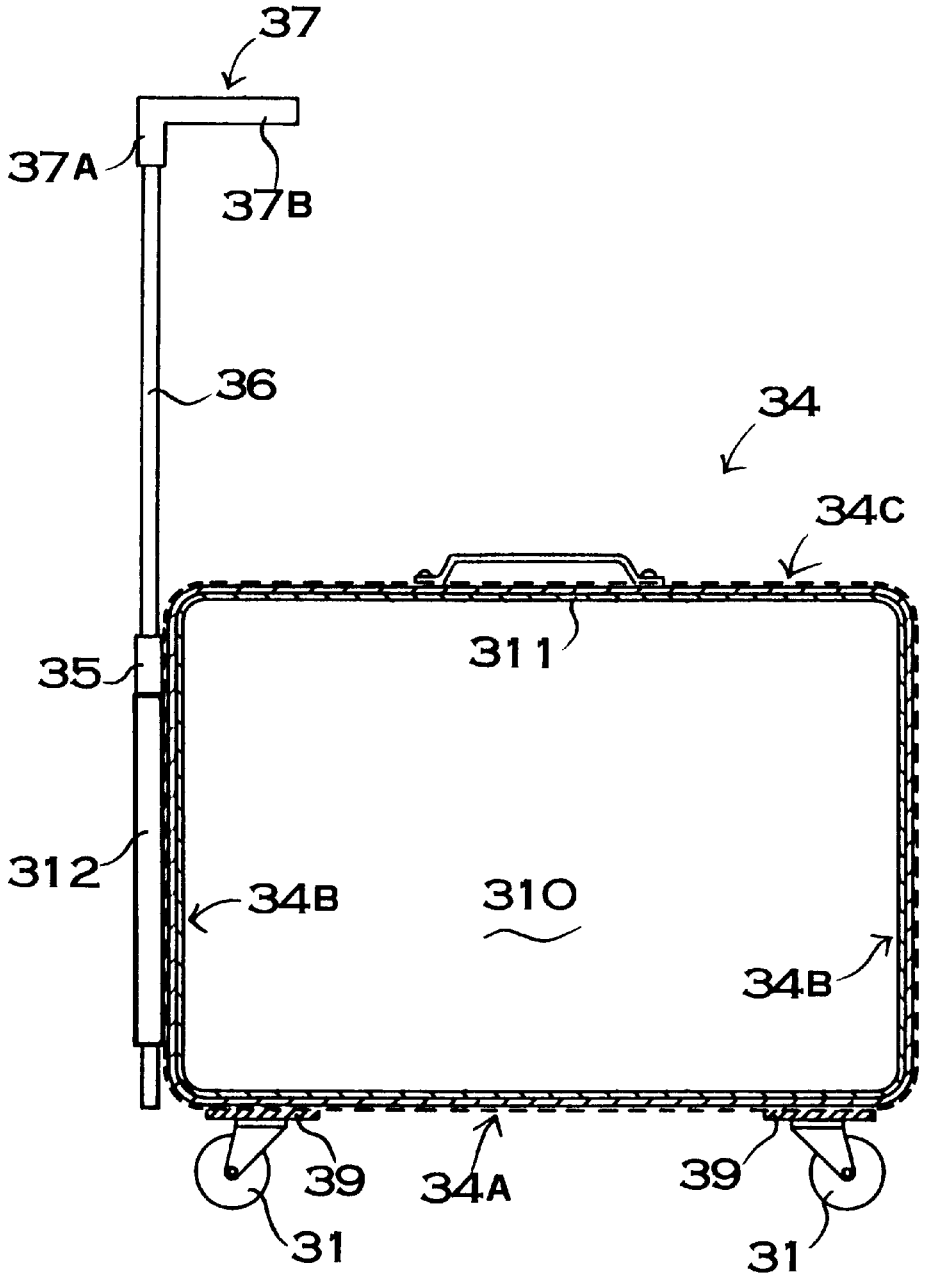
FIG. 4 is a vertical cross-sectional view of the bag shown in FIG. 3.
Figure 5:
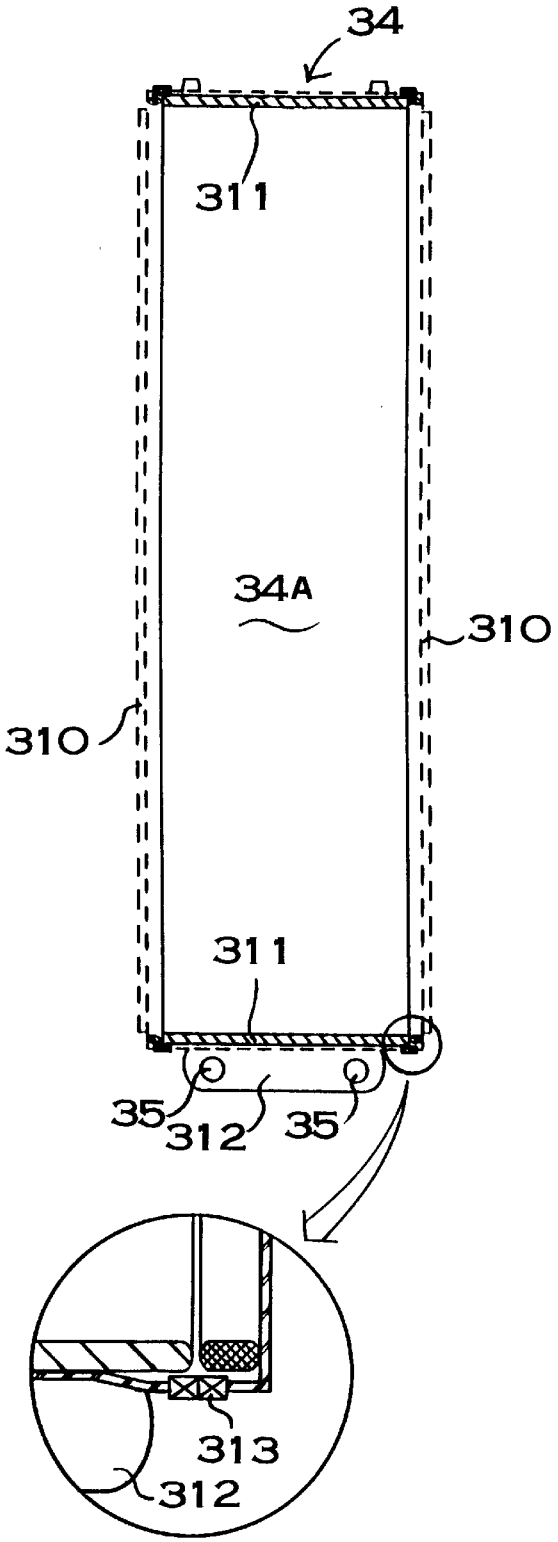
FIG. 5 is a horizontal cross-sectional view of the bag shown in FIG. 3.
Figure 6:
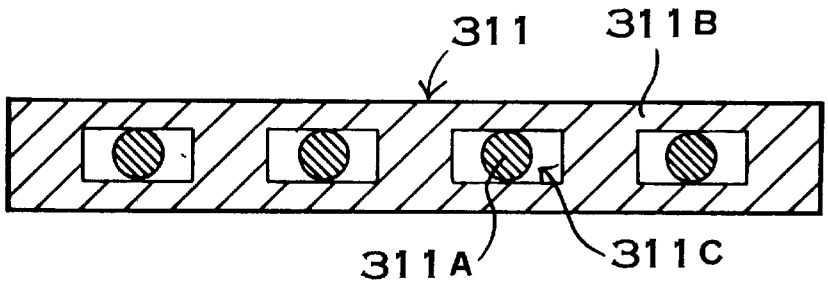
FIG. 6 is a cross-sectional view of a reinforcing frame which is located inside of the bag body shown in FIG. 3.

The bag body 34 includes a rectangular reinforcement frame 311 which is mounted at an inner face of the bag body walls, as shown in the cross-sectional views of FIGS. 4–5. Also, a hard lining and a smooth surface material are applied on the surface of the reinforcement frame. The reinforcement frame 311, shown in the cross-sectional view of FIG. 6, is a hard plastic panel 311B formed of hard vinyl chloride resin or polypropylene etc. The hard plastic panel 311B is reinforced by the insertion of wires 311A, which are bent like a frame along the inner face of the bag body 34. The reinforcement frame 311 of shown in FIG. 6 is provided with the square holes 311C extending vertically through the hard plastic panel 311B. The wires 311A are inserted into the square holes 311C and strongly reinforce the hard plastic panel 311B. A diameter of, for example 2 to 4 mm, is used for the wires 311A. The reinforcement frame 311 of this structure is constructed so as to be light and strong. However, aluminum and thin metal sheets can also be used in the reinforcement frame 311.

The hard lining can also be a thick paper panel or a thin and hard plastic panel. The hard lining can be formed by laminating with many layers of the same material or of different materials. The bag shown in FIG. 4 has a reinforcement frame 311 and a hard lining constructed of different materials, although both the reinforcement frame and the hard lining can be formed in one piece.

The smooth surface material is made of a cloth or plastic sheet. Also, at the middle of the lateral face of the smooth surface material of the bag body 34, a natural or a synthetic leather belt can be sewed as decoration material.

Further, the bag is supported on the casters 31 which are fixed to the four corners of the bottom face of the bag body 34. The casters 31 are fixed to caster supports 39, respectively. The caster supports 39 are fixed to the bottom face 34A of the bag body 34. The caster supports 39 have almost the same length as the width of the bottom face 34A of the bag body 34, and the caster supports 39 are separated into two panels in order to make the bag body lighter. The caster supports 39 are fixed to the bottom face 34A of the bag body 34 by screws or rivets. However, the caster supports can also be almost the same size as the bottom face of the bag body. To provide sufficient strength to the caster supports 39, aluminum or metal sheet etc. is used. The desirable thickness of the caster supports 39 made of aluminum is from 2 to 5 mm and is preferably from 3 to 4 mm. Perforation holes can be provided in the caster supports in order to make the caster supports 39 lighter.

The casters 31 are fixedly mounted on the caster supports 39. Also, the casters 31 are positioned at the four corners of the bottom face 34A of the bag body 34. Universal casters are generally used so that the casters 31 can freely swivel. However, it is possible to use two freely swiveling casters on the side of the bag body which is remote from the handle of the bag body and two non-swiveling casters on the side of the bag body nearest the handle. The casters 31 are fixed to the bottom face of the caster supports 39 by rivets or screws.

It should be noted that the bag of the present invention is limited to the above-mentioned structure. The bag body can also have a structure in which the cover is connected by wing nuts to allow opening and closing thereof. In this bag, the bag body and the covers are made of hard material of sufficient resistance, for example, a panel made with a material composed of fibrous material hardened with a binder, a coating material made of hard waterproof paper, and a hard plastic aluminum or other sheet metal. The thickness of the bag body and the covers is designed to resist deformation due to the introduction of fairly heavy items.

The handle 33 includes two vertical rods 36 and a grip 37 which connects the upper ends of the two vertical rods. The grip 37 has a "T" shape and is composed of a connecting part 37A that interconnects the vertical rods 36 and a gripping part 37B. The grip 37 is made of molded plastic and has holes in the bottom face of the connecting part 37A for receiving the vertical rods 36. As shown in the cross-sectional view of FIG. 7, the upper face of the gripping portion 37B is bent like a convex semicircle and the bottom face has two concave sides. The gripping portion 37B can be easily lifted while holding the concave sides. When the vertical rods 36 and the "T" shape grip 37, shown in the FIG. 3, are in an extended position, the gripping portion 37B is positioned over almost the middle of the bag body upper face 34C and extends in a longitudinal direction of the upper face 34*c* of the bag body 34. The length of the gripping portion 37B has to be at least 8 cm and is preferably 8 to 12 cm so as to allow a sure grasp of the gripping portion 37B.

Figure 7:
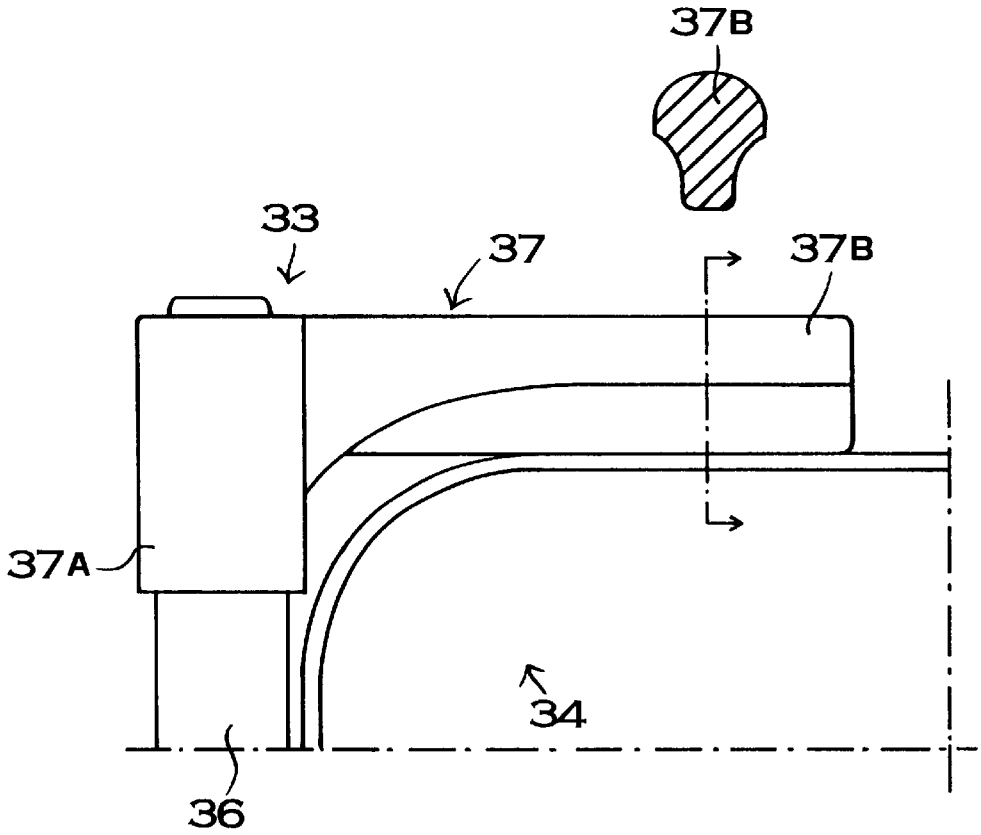
FIG. 7 is a cross-sectional view of a gripping portion and a lateral view showing the grip of the bag handle shown in FIG. 3.
Figure 9:
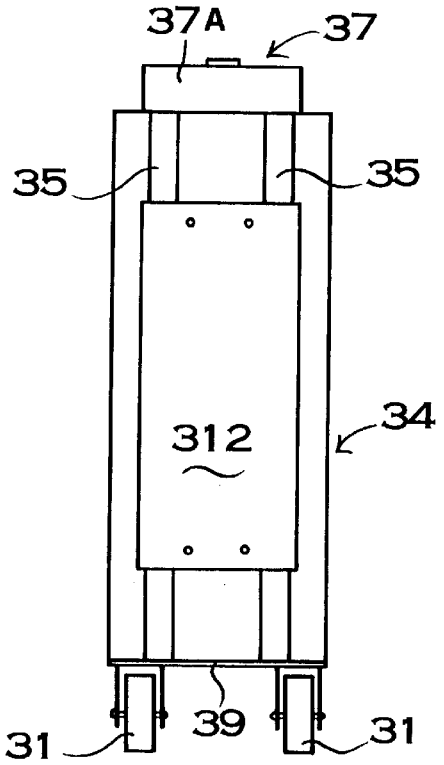
FIG. 9 is a front view as seen from the handle side of the bag shown in FIG. 3.
Figure 10:
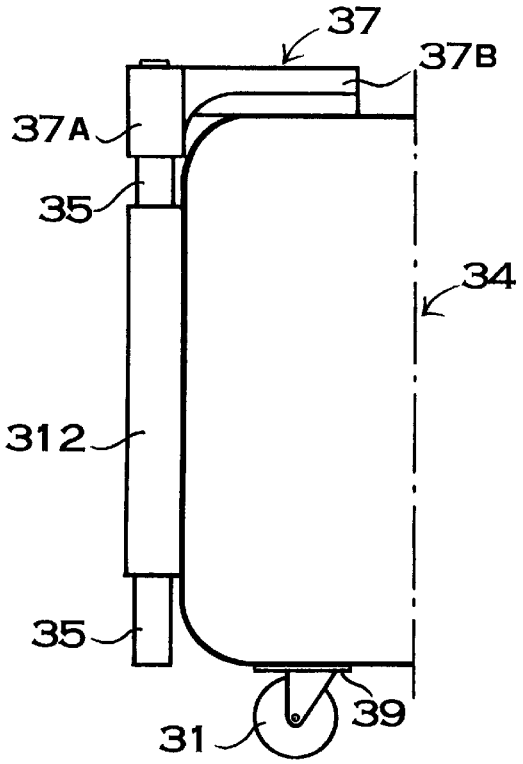
FIG. 10 is a side view of the handle of the bag shown in FIG. 3.

When the bag is moved while supported on the casters 31, as shown in FIG. 3, the grip 37 is extended from the bag. When the bag is not being moved by the casters 31, the grip 37 is pushed into a retracted position in the bag, as shown in FIG. 7, FIG. 9 and FIG. 10.

The handle 33 is locked in the extended position and in the retracted position by stoppers. The grip 37 is locked at the extended position when the grip 37 is pushed to move the bag supported on casters 31, and when a user leans on the grip 37, i.e., in other words, when the grip 37 is used as a walking stick to provide a rest. When used in these conditions, the handle 33 is prevented by the stoppers from being pushed into the bag. The grip 37 is locked in the retracted position when the bag is to be lifted and carried by grasping another grip which is fixed to the upper face of the bag body.

When the grip 37 is fully extended, the overall length of the vertical rods 36 is designed so that the distance from the bottom of the casters 31 to the grip 37 is about 90 cm. However, it is also possible to vary the distance from the bottom of the casters 31 to the grip 37 throughout a range of 60 to 100 cm. When the height of the grip 37 is 90 cm, the bag can be most easily moved by pushing and the handle can be conveniently used as a walking stick.

The two vertical rods 36 are mounted so that they can be pushed in and pulled out of the bag body through two guide pipes 35. The guide pipes 35 are fixed to opposing sides of one of the lateral side faces 34B of the bag body 34. The guide pipes 35 have a tubular shape so as to allow the vertical rods 36 to be pushed in and pulled out with little frictional resistance. As shown in FIG. 3, the guide pipes are fixed to the lateral face 34B of the bag body through a lateral fixing panel 312.

Figure 8:
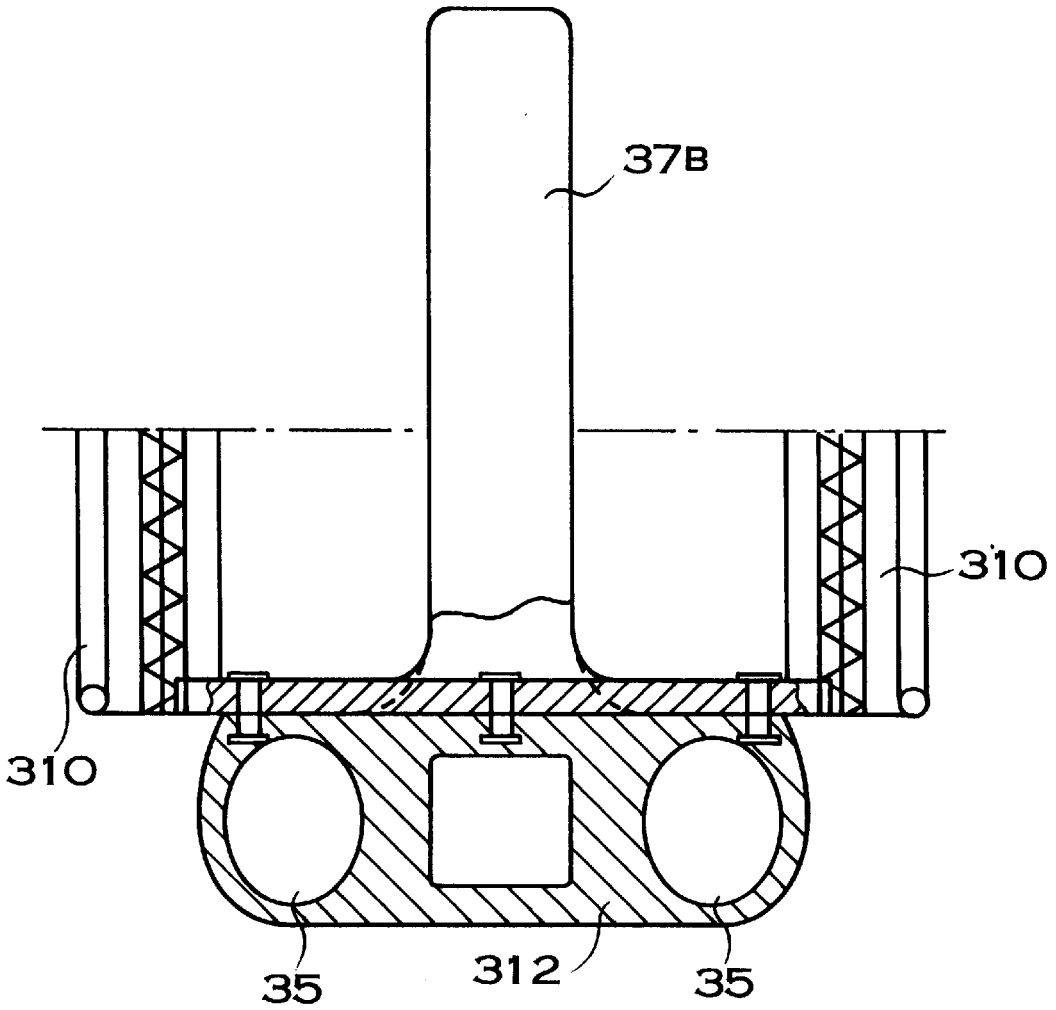
FIG. 8 is a partial cross-sectional plan view showing the handle of the bag shown in FIG. 3.

As shown in the FIG. 8, the lateral fixing panel 312 is fixed to the lateral face 34B of the bag body by means of fasteners such as screws or rivets. It is also possible to secure the lateral fixing panel 312 without fixing materials, or in addition to the fixing materials, by gluing the panel 312 to the bag body 34. The lateral fixing panel 312 is a molded plastic part that is provided on both ends with vertical holes for receiving and vertically fixing the guide pipes 35. The lateral fixing panel 312 is designed with a width which is a little narrower than the width of the bag body 34, with a thickness which is sufficient to allow insertion of guide pipes 35, and with a length which is sufficient to strongly fix the guide pipes 35 to the bag body 34. After having secured the lateral fixing panel 312 to the lateral face 34B of the bag body 34, the guide pipes 35 are inserted therein. The guide pipes 35 are mechanically secured in the lateral fixing panel by gluing or with screws (not shown in the figures). The bag, as described above, allows the guide pipes 35 to be easily, simply and surely fixed in a precise position.

When the vertical rods 36 are moved to a fully extended position, the vertical rods 36 are prevented from lowering or retracting by a stopping mechanism. Any structure that can stop the vertical rods 36 at the extended position can be used. FIG. 3 shows a bag in which each vertical rod is formed by upper and lower telescoping rod sections 36. The upper rod section is thinner than the lower rod section so as to be insertable into the lower rod section and so that it does not come off when pulled out of the lower rod section. The lower rod section is slidably inserted into the guide pipe 35 in a fashion allowing extension of the lower rod section.

Figure 11:
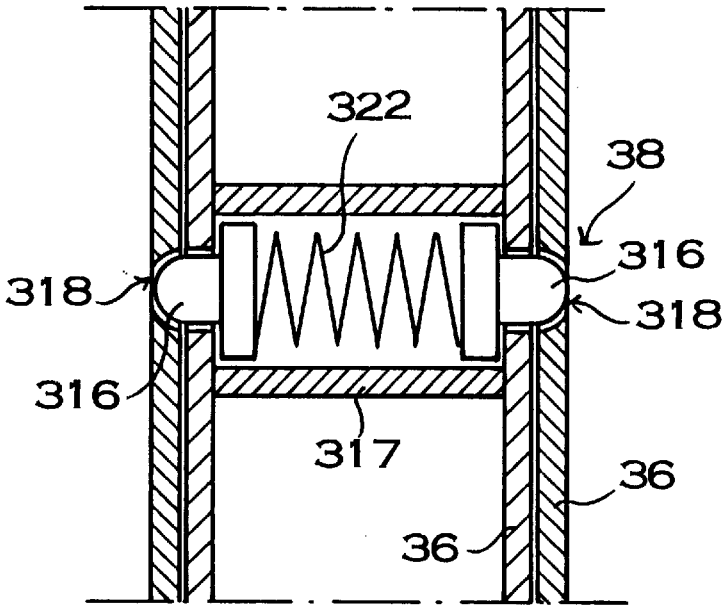
FIG. 11 is a cross-sectional view showing an example of a stopper applied on the vertical rods for stopping the handle at a predetermined position.
Figure 12:
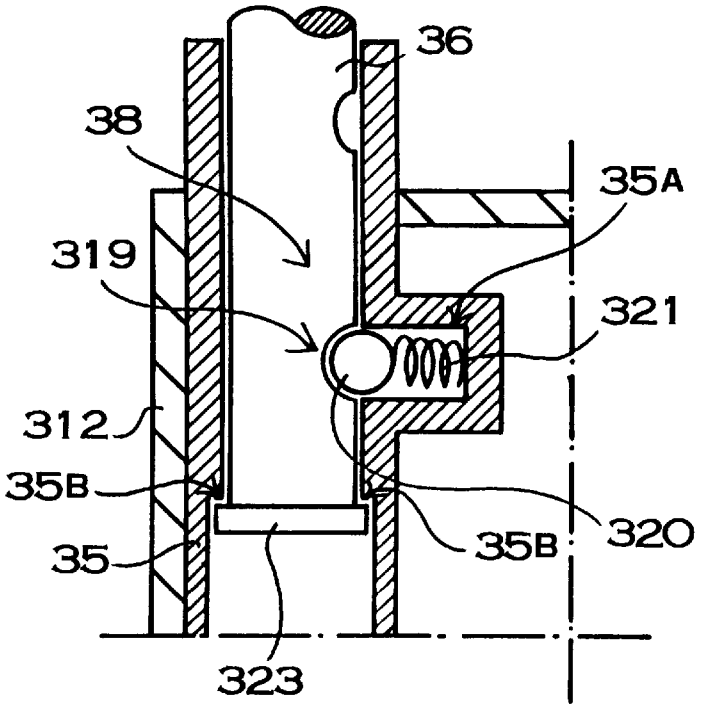
FIG. 12 is a cross-sectional view showing another example of a stopper applied on the vertical rods for stopping the handle at a predetermined position in the guide pipes.

FIGS. 11 and 12 show an example of stoppers or detents which may be employed to stop the vertical rods 36 at the extended position. FIG. 11 shows the stopper 38 of the upper and lower rod sections 36, and FIG. 12 shows the stopper 38 stopping the lower rod section 36 in the guide pipe 35. The stopper 38 of FIG. 11 is provided with an elastic protuberance 316 which elastically protrudes in the direction of the semicircle inside the upper rod section 36. The spring 322 biases the protuberance 316 outwardly and a pipe 317 encloses the spring 322 and a portion of the protuberance 316. When the protuberance 316 is pushed by the spring 322, it protrudes from a through hole formed in the upper rod section 36, and is inserted into a stopper hole 318 formed in the lower rod section 36. The protuberance 316 is mounted at a lower end portion of the upper rod section 36 and the stopper hole 318 is disposed at an upper end portion of the upper rod section 36. In the stopper 38 of this structure, the protuberance 316 enters into the stopper hole 318 when the upper rod section 36 is extended from the lower rod section 36. In this condition, the upper rod section 36 cannot be lowered relative to the lower rod section 36. When lowering the upper rod section 36, the upper rod section has to be forcefully pushed in a downward direction. Then the protuberance 316 is forcibly pushed out of stopper hole 318, and the upper rod section 36 can be lowered.

In the stopper 38 shown in FIG. 12, the ball 320 is elastically biased into a slot formed in an inner face of the vertical rod 36. A coil spring 321 is mounted between the ball 320 and a cylinder 35A to elastically bias the ball 320. The coil spring 321 elastically pushes the ball 320 outwardly of the cylinder 35A. A flange 323 is provided on the lower end of the vertical rod 36 to prevent it from being pulled out of guide pipe 35. The stepped portion 35B is formed on an inner peripheral surface of guide pipe 35 and is designed to engage the flange 323 at an upper end portion of guide pipe 35. The stopper 38 of this structure stops the vertical rod 36 at the extended upper position due to the insertion of the ball 320 into the slot 319 when the grip 37 is pulled upward and the vertical rod 36 is extended to the maximum upper position. As a result, the grip 37 stops at the maximum extended or pulled out position. Even if one tries to push the grip 37, the lowering of the grip 37 is prevented by the elastic insertion of the ball 320 into slot 319. However, when the grip 37 is forcefully pushed down, the vertical rod 36 can be lowered because the ball disengages from slot 319.

The stopper 38 shown in the FIGS. 11 and 12 can stop the grip 37 at the maximum extended position without any special manipulation. However, the grip 37 can be lowered when forcefully pushed inwardly. Therefore, the grip 37 can be easily extended to the upper position and also easily pushed back into the retracted position. An operating button for the stopper, not shown in the figures, can be placed on the grip 37 as it is already in use on other known bags. However, this type of stopper does not allow the pushing-in of the grip unless the operating button is pressed. With this type of stopper the grip can be used as a walking stick, because the grip will not lower even if it is forcefully pushed inwardly.

Furthermore, the stopper can lock the vertical rod in the fully retracted position. The stopper includes a stopper hole or a slot in the vertical rod to elastically insert an elastic protrusion or a ball when the vertical rod is in the fully retracted position.

The above-described bag has a structure allowing the extension of the vertical rods in two sections, however, guide pipes can be adapted to allow the extension (not shown) of the vertical rods in one section. Furthermore, it is also possible to form the vertical rods of three or more telescoping rod sections (not shown).

Figure 13:
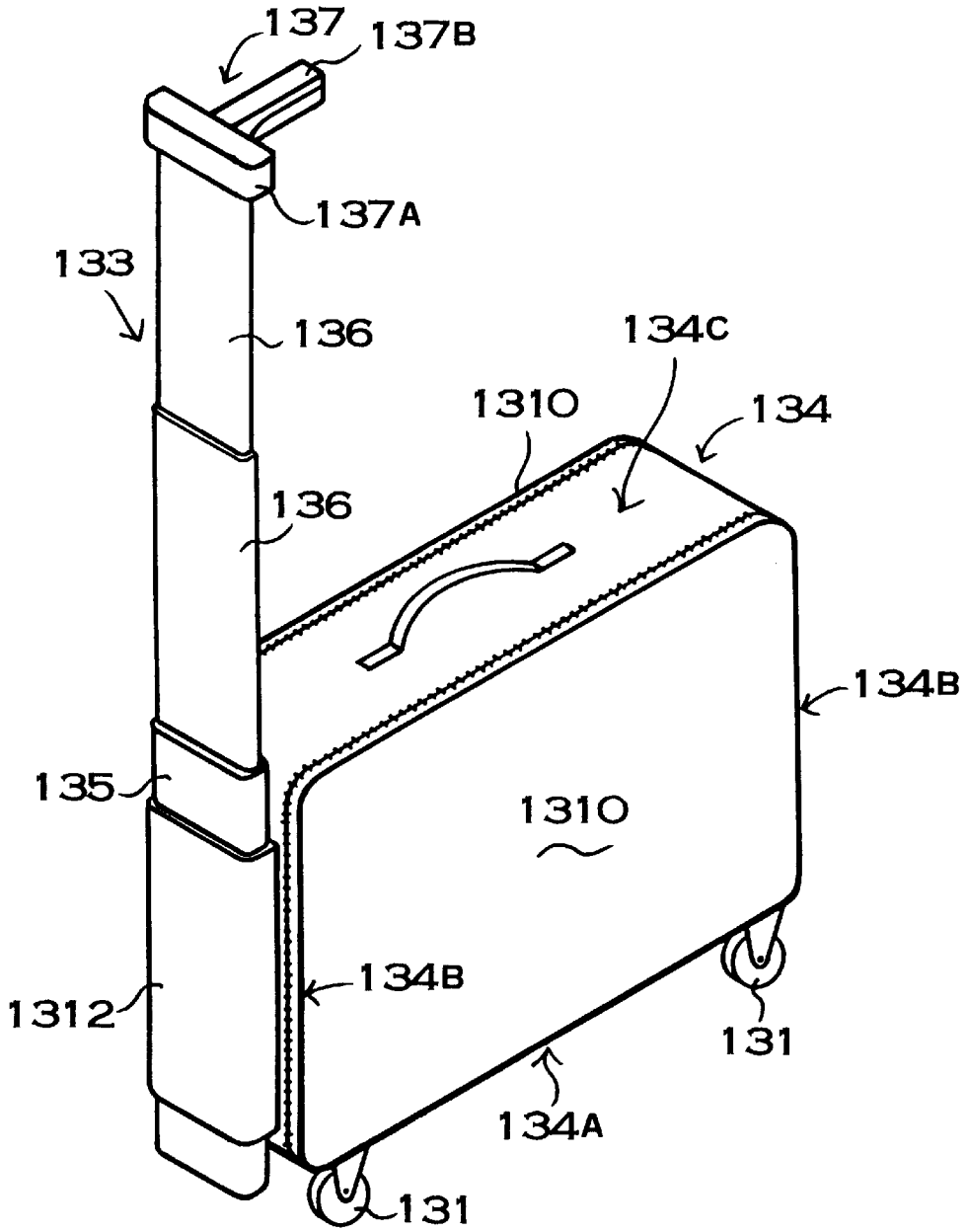
FIG. 13 is a perspective view of a bag constructed in accordance with a second embodiment of the present invention.

FIG. 13 shows the bag provided with vertical rod sections 136 and a guide pipe 135 formed of one pipe. On this bag, the guide pipe 135 has a wide breadth and is fixed to one of the lateral faces 134B of the bag body by means of a lateral fixing panel 1312. The guide pipe is parallel to the lateral side 134B of the bag body 134. The vertical rod sections 136 are slidable in the wide breadth guide pipe 135 in a freely up-down extensible fashion. The grip 137 is fixed at the upper end of the wide breadth rod. The grip 137 used in this embodiment is almost the same as the grip employed in the bag shown in FIG. 3. The vertical rod sections 136 are inserted into the guide pipe 135, and are provided with stoppers to maintain the vertical position when stopped at the upper extended position. The stoppers shown in FIGS. 11 and 12 can be used. The grip 137 is locked by the stopper at the upper or fully extended position, as in the bag shown in the FIG. 3. The grip has a height of for example 60 to 100 cm from the lower extremities of the casters 131 to the gripping portion 137B of the grip 137. The most suitable height is approximately 90 cm. The entire structure of the embodiment shown in FIG. 13 can be easily realized because the guide pipe 135 and the vertical rod 136 can be formed of only one section. With the bag shown in FIG. 13, tipping of the bag body to one side or the other can be surely prevented because the widths of the vertical rods 136 and of the guide pipe 135 are made wider thereby reinforcing the lateral resistance. Further, the vertical rods 136 with a wide widths which effectively prevent the twisting of the rod. In the FIG. 13, 131 denotes the casters, 133 denotes the handle, 134A denotes the bottom face of the bag body, 134C denotes the upper face of the bag body, 137A denotes the connecting part of the grip, and 1310 denotes the cover. Also, a carrying handle is provided on the upper face 134C.

Figure 14:
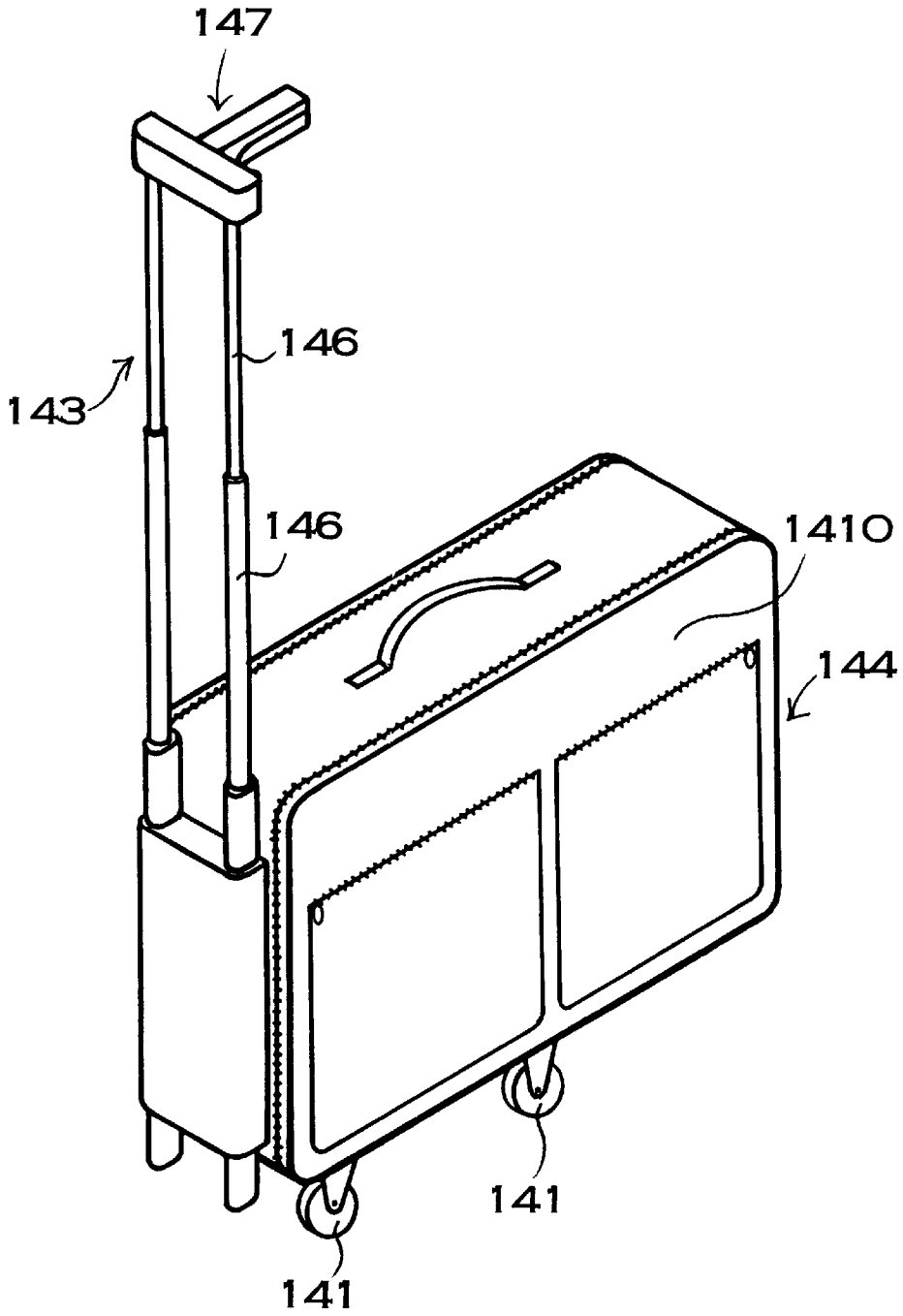
FIG. 14 is a perspective view of a bag constructed in accordance with a third embodiment of the present invention.

It is not necessary to fix the casters to the four corners of the bag body bottom surface. As shown in the FIG. 14, it is possible to position the pair of casters 141, that are located away from the handle 143, closer towards the center of the bag body 144. Also, in FIG. 14, 146 denotes the vertical rods, and 1410 denotes the cover.

As this invention may be embodied in several forms without departing from the spirit or essential characteristics thereof, the present embodiments are therefore illustrative and not restrictive, since the scope of the invention is defined by the appended claims rather than by the description preceding them. Also, all changes that fall within the metes and bounds of the claims, or equivalence of such metes and bounds thereof are therefore intended to be embraced by the claims.

What is claimed is:

1. A bag comprising:

a bag body having a first side, a second side, an upper side connected to upper edges of said first and second sides, and a bottom side connected to lower edges of said first and second sides, wherein said upper side has a longitudinal direction;

four casters mounted to said bottom side of said bag body such that said bag body can be moved while in a vertical self-standing posture, wherein said bottom side of said bag body is approximately rectangular in shape and defines four corners, and said casters are fixed in the vicinity of said four corners of said bag body, respectively;

a pair of guide pipes fixedly mounted on said first side of said bag body;

an extendable and retractable handle fixed to said first side of said bag body, said handle including a grip and a pair of vertical rods slidably received in said guide pipes, respectively, each of said guide pipes having an upper end, said grip including a connecting portion and a gripping portion, said connecting portion interconnecting said upper ends of said vertical rods, and said gripping portion being located approximately at a central portion of said upper side of said bag body and extending in the longitudinal direction of said upper side of said bag body, wherein, upon vertical displacement of said gripping portion to a fully extended use position of said handle, said gripping portion is positioned directly vertically over a position of said gripping portion, adjacent said upper side of said bag body, when said handle is in a fully retracted position; and a stopper mechanism for stopping said extendible vertical rods in the fully extended position thereof.

2. The bag as claimed in claim 1, wherein at least two of said four casters are universal casters, and said universal casters allow a movement direction of said bag body to be freely changed.

3. The bag as claimed in claim 1, further comprising:

third and fourth sides of said bag body, said third and fourth sides each extending between said first and second sides;

a first cover forming at least a portion of said third side of said bag body, wherein said first cover can be opened to permit access to an interior space defined by said bag body; and a second cover forming at least a portion of said fourth side of said bag body, wherein said second cover can be opened to permit access to said interior space defined by said bag body.

4. The bag as claimed in claim 1, further comprising a caster support fixed to said bottom side of said bag body, wherein said casters are mounted to said caster support.

5. The bag as claimed in claim 1, wherein said bag body has a thickness of 10 to 25 cm.

6. The bag as claimed in claim 1, wherein said connecting portion and said gripping portion form a T-shaped structure which lies in a horizontal plane when said bag body is in an upright traveling position.

7. The bag as claimed in claim 1, wherein said gripping portion of said grip has a cross-section with a convex semicircular upper face and a bottom face which defines two concave sides.

8. The bag as claimed in claim 1, further comprising a carrying handle secured on a middle portion of said upper side of said bag body.

9. The bag as claimed in claim 1, wherein said stopper mechanism locks said grip at the fully extended position and at the fully retracted position.

10. The bag as claimed in claim 1, further comprising a fixing panel for securing said guide pipes to said first side of said bag body.

11. The bag as claimed in claim 10, wherein said fixing panel has a width which is slightly narrower than a width of said first side of said bag body.

12. The bag as claimed in claim 1, wherein said gripping portion, at the fully extended position of said handle, has a height of 60 to 100 cm as measured between a lower surface of said casters to said gripping portion.

13. The bag as claimed in claim 1, wherein said vertical rods are perpendicular relative to said upper side of said bag body when said handle is in the fully extended use position.

14. A bag comprising:

a bag body having a first side, a second side, an upper side connected to upper edges of said first and second sides, and a bottom side connected to lower edges of said first and second sides, wherein said upper side has a longitudinal direction;

four casters mounted to said bottom side of said bag body such that said bag body can be moved while in a vertical self-standing posture, wherein at least two of said casters are universal casters which are each freely pivotable about a central axis so as to allow a movement direction of said bag body to be freely changed;

a wide breadth guide pipe fixedly mounted on said first side of said bag body;

an extendable and retractable handle fixed to said first side of said bag body, said handle including a grip and a wide breadth vertical rod slidably received in said guide pipe, said guide pipe having an upper end, said grip including a connecting portion and a gripping portion, said connecting portion being connected to said upper end of said vertical rod, and said gripping portion being located near a central portion of said upper side of said bag body and extending in the longitudinal direction of said upper side of said bag body, wherein, upon movement of said handle from a fully retracted position to a fully extended use position, said gripping portion is displaced only vertically relative to said upper side of said bag body such that said gripping portion is positioned directly vertically over a position of said gripping portion adjacent said upper side of said bag body, when said handle is in the fully retracted position; and a stopper mechanism for stopping said extendible handle in the fully extended position thereof.

15. The bag as claimed in claim 14, further comprising:

third and fourth sides of said bag body, said third and fourth sides each extending between said first and second sides;

a first cover forming at least a portion of said third side of said bag body, wherein said first cover can be opened to permit access to an interior space defined by said bag body; and a second cover forming at least a portion of said fourth side of said bag body, wherein said second cover can be opened to permit access to said interior space defined by said bag body.

16. The bag as claimed in claim 14, further comprising a caster support fixed to said bottom side of said bag body, wherein said casters are mounted to said caster support.

17. The bag as claimed in claim 14, wherein said bag body as a thickness of 10 to 25 cm.

18. The bag as claimed in claim 14, wherein said connecting portion and said gripping portion form a horizontal T-shaped structure.

19. The bag as claimed in claim 14, wherein said gripping portion has a cross-section with a convex semicircular upper face and a bottom face defining two concave sides.

20. The bag as claimed in claim 14, further comprising a carry handle secured to a middle portion of said upper side of said bag body.

21. The bag as claimed in claim 14, wherein said stopper mechanism locks said grip at the fully extended position and at the fully retracted position.

22. The bag as claimed in claim 14, further comprising a fixing panel for securing said guide pipe to said first side of said bag body.

23. The bag as claimed in claim 22, wherein said fixing panel has a width which is slightly narrower than a width of said first side of said bag body.

24. The bag as claimed in claim 14, wherein said gripping portion, at the fully extended position of said handle, has a height of 60 to 100 cm as measured between a lower surface of said casters to said gripping portion.

25. The bag as claimed in claim 14, wherein said wide breadth vertical rod is substantially perpendicular relative to said upper side of said bag body when said handle is in the fully extended use position.

26. The bag as claimed in claim 14, wherein said wide breadth vertical rod and said grip form an inverted L-shaped handle.

* * * * *